United States Patent [19]

Fukayama et al.

[11] Patent Number: 4,888,953

[45] Date of Patent: Dec. 26, 1989

[54] APPARATUS FOR CONTROLLING BOILER/TURBINE PLANT

[75] Inventors: Yukio Fukayama; Taku Oshima; Shigeyoshi Kawano, all of Kure, Japan

[73] Assignee: Babcock-Hitachi Kabushiki Kaisha, Tokyo, Japan

[21] Appl. No.: 269,899

[22] Filed: Nov. 10, 1988

[30] Foreign Application Priority Data

Nov. 13, 1987 [JP] Japan ..... 62-286900
Oct. 13, 1988 [JP] Japan ..... 63-256001

[51] Int. Cl.[4] ..... F01K 13/02
[52] U.S. Cl. ..... 60/657; 60/646
[58] Field of Search ..... 60/646, 657

[56] References Cited

U.S. PATENT DOCUMENTS 4,589,255 5/1986 Martens ..... 60/646
4,651,533 3/1987 Ura et al. ..... 60/646 X
4,792,912 12/1988 Kuramoto et al. ..... 60/646 X

*Primary Examiner*—Allen M. Ostrager
*Attorney, Agent, or Firm*—Antonelli, Terry & Wands

[57] ABSTRACT

A boiler/turbine plant controlling apparatus comprises a circuit for driving a turbine inlet steam flow regulator valve on the basis of a difference between a load command signal adjusted by a thermal stress value of a turbine and an actually measured output signal of a plant; a circuit for driving a boiler feed water flow regulator valve on the basis of a difference between a value which is obtained by adding a boiler feed water amount with a super heater feed water amount and a value represented by a boiler input command signal; a circuit for driving a fuel flow regulator valve in accordance with an actually measured fuel amount and a fuel command signal corrected by a difference signal between a primary steam temperature setting signal and a steam temperature signal representative of a primary steam temperature measured value; a circuit for driving a super heater water feed valve on the basis of a difference value between the primary steam temperature setting signal and the steam temperature signal; a circuit for calculating a steam temperature drop through the steam flow regulator valve on the basis of an opening degree of the steam flow regulator valve disposed at an inlet of the turbine and a temperature and pressure of steam at the inlet of said steam flow regulator valve; and a circuit for correcting the steam temperature setting signal on the basis of the calculated value of the calculating means.

5 Claims, 8 Drawing Sheets

APPARATUS FOR CONTROLLING BOILER/TURBINE PLANT

FIELD OF THE INVENTION AND RELATED ART STATEMENT

The present invention relates to an apparatus for controlling a boiler/turbine plant, and more particularly to an apparatus for controlling a boiler/turbine plant used in, for example, a thermal power plant.

In such a plant, state quantities of steam to be fed from a boiler to a turbine are controlled in response to a load of the turbine. However, if the state quantities, e.g. temperature or pressure, would be controlled directly in response to changes in turbine load, there is a fear that considerably large thermal stress would be generated in turbine rotors to break them down because an amount of steam fed to the turbine is remarkably increased or decreased in a transient stage of the operation of the plant, such as turbine starting.

For this reason, the conventional plant is provided with a supervisory control system for supervising the thermal stress generated in the turbine of the plant. The supervisory control system serves to operate a regulator valve (a governor) for adjusting the flow rate of the steam fed from the boiler to the turbine so as to maintain the thermal stress of the turbine below a predetermined level. However, in a transient stage where the turbine load is changed remarkably and rapidly, the supervisory control system is frequently operated, so that a period of time for startup of the plant is prolonged to thereby degrade the operational performance of the power plant.

The above-described prolongation of startup causes an unexpected confusion in an operational schedule or in a plan of an electric power supply system. For this reason, according to the prior art, in order to mainly avoid the frequent operation of the supervisory control system, a boiler is sometimes controlled under an unduly small temperature rising rate to suppress a rise of temperature of steam at an outlet thereof. However, this would lead to a degradation of the inherent plant starting performance.

OBJECTS AND SUMMARY OF THE INVENTION

Accordingly, in order to overcome the above-described defects inherent in the prior art, an object of the present invention is to provide an apparatus for controlling a boiler/turbine plant so as to pick up a sufficient plant starting performance while avoiding the excessive thermal stress of the turbine.

To this end, according to the present invention, the plant is so controlled that a steam temperature changing rate, at an inlet of a blade row of a turbine, is changed, which rate inherently contributes to a life consumption of the turbine, in view of the fact that a temperature and a pressure of steam at an outlet of a heater are only considered as state quantities of steam in the conventional controlling apparatus as a result of which the above-described trouble is raised in the turbine due to the increase of thermal stress therein. Furthermore, in order to keep the turbine life consumption at a predetermined level at each starting operation, it is necessary to limit a peak of the thermal stress generated in the turbine with a certain level. In view of this point, the temperature changing rate of steam at the turbine inlet is to be controlled suitably.

According to the present invention, in order to control the inlet steam temperature changing rate at the inlet of the blade row of the turbine, the apparatus is mainly composed of means for relating such inlet steam temperature changing rate to the outlet steam temperature rising rate at the outlet of the boiler in view of that the steam temperature at the inlet of the blade row of the turbine changes according to an opening degree and an opening degree changing rate of a flow regulator valve.

Also, according to the invention, the temperature of steam at the inlet of the blade row of the turbine is not directly measured. Namely, a value to which the turbine inlet steam temperature is converged may be immediately known. According this, it can be possible to avoid a problem of the inherent time lag of detection due to a thermal capacity of a detection end (inclusive of a thermowell or the like) in such a case where the inlet temperature of the turbine is measured by a thermocouple, while the affect of the time lag due to the thermal capacity of passageways extending to the above-described regulating valve and the turbine can be considered.

According to the invention, the steam temperature control is carried out so as to suppress the change of an estimate of the turbine inlet steam temperature. To this end, the present invention employ a prediction control method in which a control is carried out with knowing the convergent value of the subject in question in advance rather than with knowing the directly measured value that would be subjected to the affect of various time lags.

In the preferred embodiment, an outlet of the steam flow regulator valve is directly and immediately connected to the inlet of the blade row of the turbine.

DETAILED DESCRIPTION OF THE PREFERRED EMBODIMENTS

The present invention will now be described hereinunder in connection with the preferred embodiments with reference to the accompanying drawings.

Figure 1:
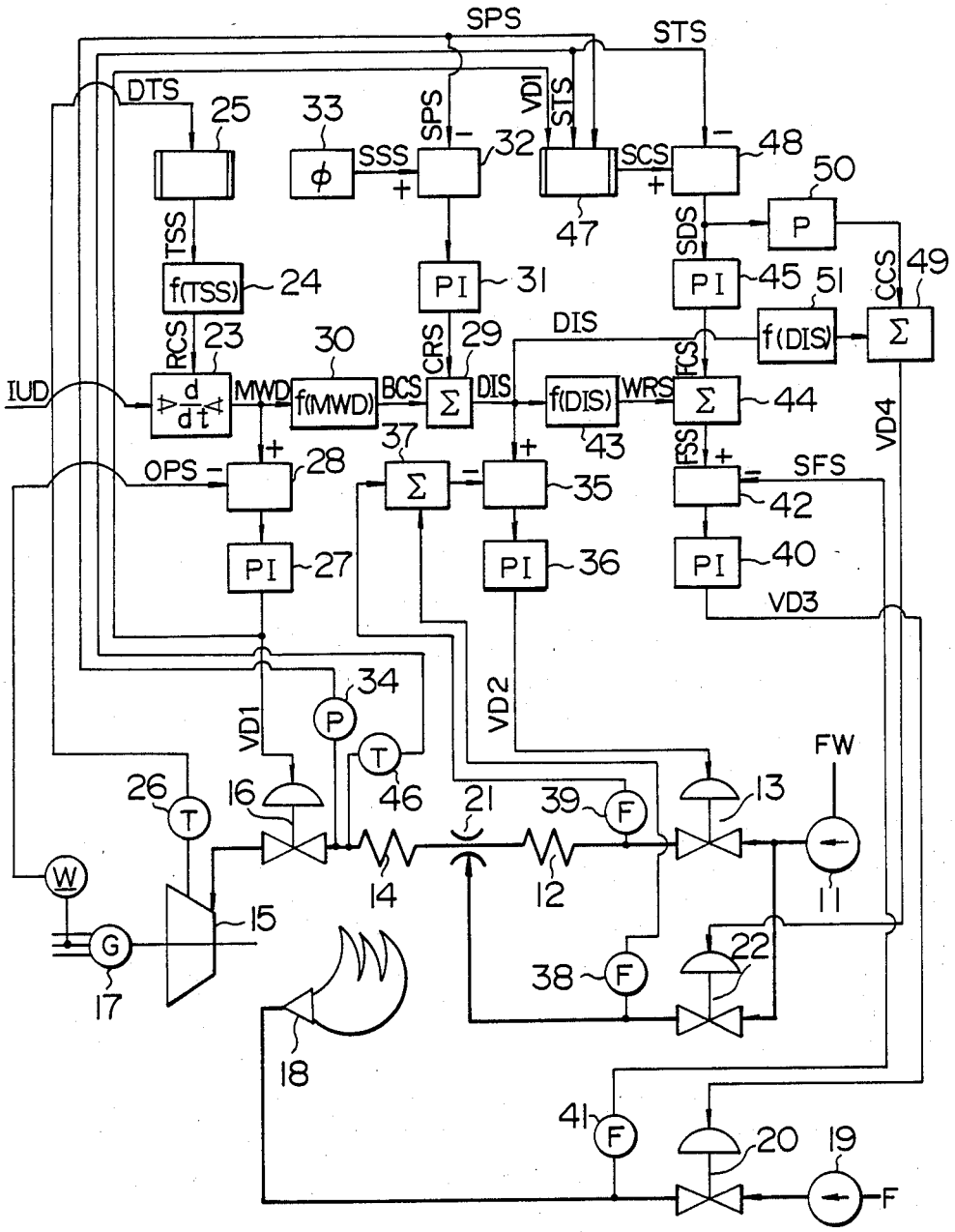
FIG. 1 is a block diagram of a first embodiment of the invention.

Referring now to FIG. 1, boiler feed water FW is pumped by a feed water pump 11 towards a steam generator 12 through a flow regulator valve 13 and becomes steam in the steam generator 12. The steam from the steam generator 12 is further heated by a heater 14 and forwarded to a turbine 15 through a flow regulator valve 16. An output shaft of the turbine 15 is connected to an input shaft of a generator 17. The steam drives the turbine 15 to operate the generator 17 so as to generate electric power. The flow regulator valve 16 controls an amount of steam to be supplied to the turbine 15 to change an output of the generator 17. A temperature and a pressure of steam are, in general, expressed at values at an outlet of the heater 14 as so called "state quantity". The pressure depends on a feed water flow rate through the valve 13, whereas the temperature depends on a flow rate of fuel F to be fed to a burner 18 from a fuel pump 19 through a fuel flow regulator valve 20. Further, since the responsibility of steam temperature control by changing of fuel flow rate of the burner 18 is a low, water is always supplied to the boiler for decreasing the steam temperature by a cooling means 21 through a regulator valve 22 so that during the transient steam temperature change, a rapid temperature change of steam can be obtained by controlling the amount of water to be supplied to the cooling means 21 through the regulator valve 22.

The constitution of the controlling apparatus which is applied to the above-described boiler/turbine plant is shown in the upper part of FIG. 1. The controlling apparatus causes the generator 17 to output electric power in accordance with a pure turbine load command signal IUD with keeping the boiler steam conditions at predetermined levels.

The pure turbine load command signal IUD representing the turbine load is so processed into a turbine load command signal MWD by a restrictor 23 that the load change rate is within a set change rate represented by a restricting command signal RCS. Namely, in case that the set change rate is defined at, for example, 3%/min by the restricting command signal RCS, even if the pure turbine load command signal IUD is abruptly changes (i.e. change rate is large), such signal IUD is changed into the turbine load command signal MWD under the set change rate of 3%/min. If, to the contrary, the set change rate is defined at 0%/min by the restricting command signal RCS, the turbine load command signal MWD is kept in a level identical to the present level of the pure turbine load command signal IUD. Namely the pure turbine load command signal IUD at the present is maintained. Therefore, the turbine load command signal MWD is a load command signal in consideration of the followability for the plant. The restricting command signal RCS is obtained from a function generator 24 that the restricting command signal RCS makes the set change rate zero in case that a level of a thermal stress signal TSS from a turbine thermal stress monitoring apparatus 25 exceeds a predetermined level. In this case the plant shown in FIG. 1 is in a condition of the fixed load control. The turbine thermal stress monitoring apparatus 25 is used to indirectly detect a inner turbine rotor temperature distribution. Such apparatus is disclosed in, for example, "Thermal and Nuclear Power" Vol. 29, No. 5 (June, 1980), pp. 437–482. According to the apparatus 25, it becomes possible to detect the state quantities of the turbine rotor, which can not be directly detected. The apparatus 25 reads steam temperature around the turbine rotor detected by a steam temperature detecting device 26, which is represented by a signal DTS. The apparatus 25 calculates a turbine rotor surface temperature distribution with taking a heat transmission property of the turbine rotor into consideration and calculates an inner turbine rotor temperature distribution with taking a heat conduction property thereof into consideration, and then obtains the thermal stress signal TSS.

A regulator valve drive command signal VD1 is delivered towards the flow regulator valve 16 to change the opening degree thereof through a proportional-integral control circuit 27 in which the command signal VD1 is so compensated as to make an output signal OPS representing the output of the generator 17 identical with the turbine load command signal MWD at a subtracter circuit 28 or make a deviation between the output signal OPS and the command signal MWD zero.

A feed water control is also carried out with taking the amount of steam discharged out from the boiler and the amount of water contained within the boiler.

At first, a desired boiler input command signal DIS is obtained from a summing circuit 29 by adding a basic command signal BCS from a load/water rate function generator 30 to a compensated load/water rate command signal CRS. The compensated command signal CRS can be obtained through by a proportional-integral control circuit 31 in which a deviation from a subtractor circuit 32 between a main steam pressure setting command signal SSS from a steam pressure setter 33 and a main steam pressure signal SPS from a steam pressure detecting device 34 is proportionally and integrally controlled. The signal DIS represents a desired total amount of water for the boiler. A command signal representing a deviation from a subtractor circuit 35 between the desired total amount of water for boiler and the total amount of water actually fed into boiler is delivered as a regulator valve drive command signal DV2 through a proportional-integral control circuit 36 to the flow regulator valve 13 to operate it to control an amount of feed water to be fed into the boiler. The signal representing the total amount of water actually fed into the boiler is obtained at a summing circuit 37 by adding a signal from a metering device 38 for detecting an amount of feed water fed into the boiler and a signal from a metering device 39 for detecting an amount of feed water fed into the cooling means 21. The reason why the command signal VD2 is not delivered to the regulator valve 22 resides in that the regulator valve 22 exclusively serves to control the temperature of steam in the boiler, not amount of water in the boiler as described later. According this, the regulator valve 13 is so controlled as to compensate not only the change of amount of water fed into the boiler through the regulator valve 13 but also the change of amount of water fed to the cooling means 21 through the regulator valve 22.

In connection with fuel supply to the burner 18, the fuel flow regulator valve 20 is so operated in a controlled manner by a valve drive command signal VD3 from a proportional-integral control circuit 40 that a fuel supply command signal FSS becomes identical to a supplied fuel signal SFS from a fuel metering device 41 representing an actual amount of fuel fed to the burner 18, i.e. a deviation between signals FSS and SFS becomes zero at a subtractor circuit 42. The fuel supply command signal FSS is obtained at a summing circuit 44 by adding a water/fuel rate correcting signal FCS into a water/fuel rate signal WRS which is obtained through a function generator 43 on the basis of the desired boiler input command signal DIS. The water/fuel rate correcting signal FCS is obtained through a proportional-integral control circuit 45 from a steam temperature deviation signal SDS representing a deviation between a steam temperature signal STS from a steam temperature detecting device 46 and a steam temperature setting command signal SCS from a steam temperature setting value calculator 47. Such deviation is determined at a subtractor circuit 48.

The regulator valve 22 is used to complement a slow response in the steam temperature control due to fuel supply control as described hereinabove, the regulator valve 22 is controlled by a valve drive command signal VD4 which is obtained at a summing circuit 49 by adding a cooling means water/fuel rate correcting command signal CCS which is obtained through a proportional control circuit 50 on the basis of the deviation signal SDS with a feed water amount signal output from a function generator 51 on the basis of the signal DIS.

Figure 2:
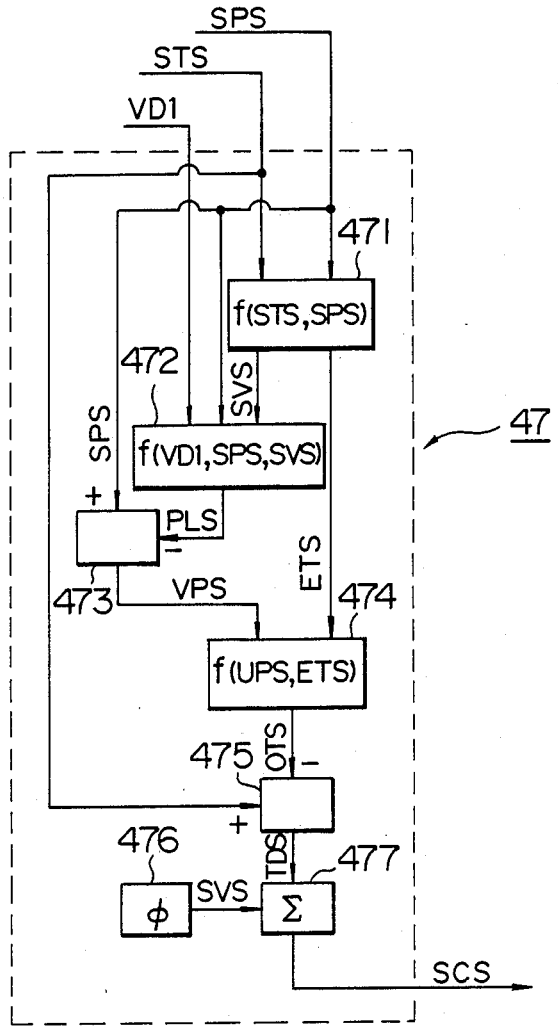
Fig.2 is a view showing a detail of a steam temperature setting value calculator shown in FIG. 1.

FIG. 2 shows the details of the steam temperature setting value calculator 47. The calculator 47 includes a steam table referencing circuit 471 which receives the steam pressure signal SPS and the steam temperature signal STS to thereby obtain a specific volume signal SVS representing a specific volume of steam in the inlet of the valve 16 and an enthalpy signal ETS representing an enthalpy thereof. The specific volume and the enthalpy can be calculated by the interpolation with using the steam table or may be calculated by approximation.

A valve characteristic function circuit 472 receives the steam pressure signal SPS and the valve drive command signal VD1 of the valve 16 to determine the flow rate through the valve 16 from the pressure/flow rate characteristics with taking the turbine 15 and the valve 16 as a whole into consideration, and subsequently, calculates a valve differential pressure from the flow rate through the valve 16 and output a pressure loss signal PLS. This calculation may be also performed by the interpolation with steam table or by the characteristic approximation.

A subtractor circuit 473 subtracts the signal PLS from the steam pressure signal SPS to provide a valve outlet pressure signal VPS. A steam table referencing circuit 474 provides a steam temperature signal OTS corresponding to the outlet pressure in the valve 16 at the same enthalpy as the inlet of the valve 16 in the same manner as in the circuit 471.

A subtractor circuit 475 subtracts the signal OTS from the signal STS to output a temperature decreasing width signal TDS representing a temperature decrease due to the valve 16. A steam temperature setter 476 sets a steam temperature set value signal SVS which denotes a preferable outlet steam temperature of the valve 56 (hence the inlet of the turbine 15). Usually, this value signal SVS is kept constant. However, in the case where the turbine 15 is cooled down as in the starting stage, for example, the value signal SVS is gradually increased from a low temperature set value to a predetermined value.

A summing circuit 477 adds the temperature decreasing width signal TDS with the steam temperature set value signal SVS to output the steam temperature setting command signal SCS.

Now, the relationship between the present invention and the prior art will now be explained with reference to FIG. 5.

Figure 5:
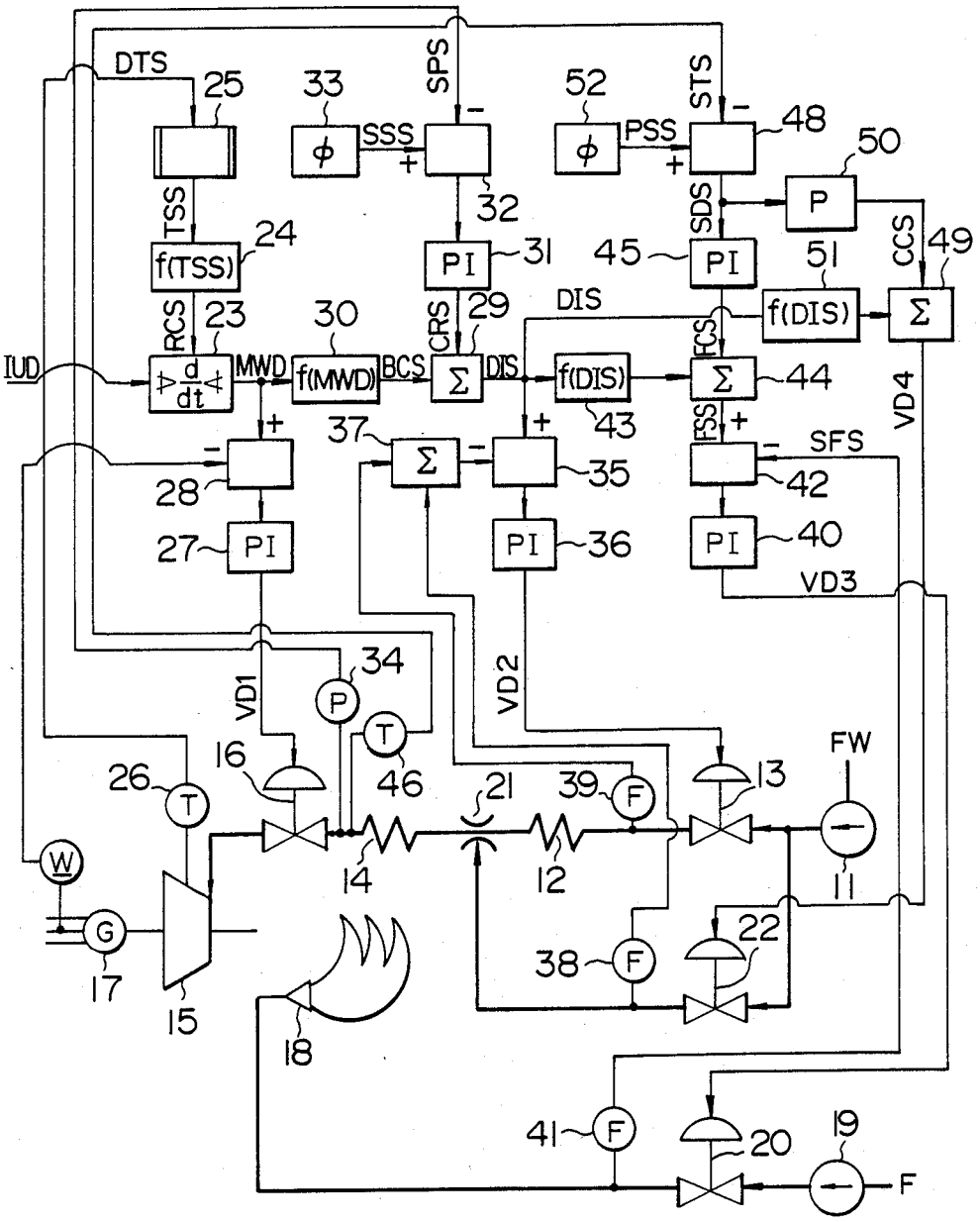
FIG. 5 is a block diagram of the prior art.

A difference between the above embodiment and the prior art resides in the signal setting circuit 52 for outputting a primary steam temperature setting signal PSS (see FIG. 5). The signal setting circuit 52 is used instead of the steam temperature setting value calculator 47. The other arrangement is substantially the same as that shown in FIG. 1.

In the conventional apparatus, the load control is performed by the adjustment of the removal amount of the steam by the valve 16. At this time, according this, the pressure drop and the temperature drop would be generated. The pressure drop is needed for adjustment of the steam amount flowing into the turbine 15. This pressure drop itself would not cause any problem. However, the temperature drop concomitant with the pressure drop would cause the thermal stress in the turbine 15 for the following reason.

The steam temperature drop is due to the fact that the temperature is changed as the pressure is changed, even if the enthalpy (including a heat quantity) of the steam would not be changed at the inlet and outlet of the valve 16. In other words, when the steam is expanded as the pressure is lowered, the internal energy is decreased corresponding to a work done by the steam expansion to lower the temperature. However, at the region where the reduction of the opening degree of the valve 16 is remarkable, the temperature drop is also remarkable to reach a temperature of 100° C. It is possible to readily confirm this situation of the pressure drop at the constant enthalpy by using the steam table issued by Japanese Society of Mechanical Engineering (JSME).

In the control system shown in FIG. 5, the temperature and the pressure of the steam at the outlet of the heater 14 are controlled as the steam state quantities. Thus, it whould not be difficult to limit the steam pressure deviation within a range of $\pm 5$ kg/cm$^2$ under high load change rate of about 5%/min. However, due to the valve opening change of the regulator valve 16 concomitant with the load change, the steam temperature at the inlet of the turbine 15 passing through the valve 16 is changed in the order of several tens °C. This would cause the serious thermal stress in the turbine rotor.

In view of the above-noted fact, the turbine thermal stress monitoring apparatus or supervisory control system 25 is provided in order to ensure the reliability of the turbine rotor. However, the thermal stress (represented by the signal TSS) would frequently be larged to suppress the opening degree change of the regulator valve 16. Therefore, a load change rate restrictor function or a load fixing function is effected by the function generator 24 on the restrictor 23, so that the load change period is prolonged to degrade the operational performance of the power plant.

Furthermore, in the starting stage of the thermal power plant, there would be serious problems due to the same phenomenon. More specifically, in the starting transient process, the temperature of the steam at the outlet of the heater 14 is elevated to reach a predetermined level upon the completion of the starting operation, and at the same time, the opening degree of the regulator valve 16 is increased from the reduced condition to the increased condition. However, under this condition, the difference between the increase of the steam temperature at the inlet of the regulator valve 16 and the steam temperature drop by the regulator valve 16 exceeds about 100° C. The temperature is abruptly decreased. Therefore, in some cases, the temperature of the steam at the inlet of the turbine 15 is abruptly increased. Thus, during the starting transient stage, the load fixing function is most likely to be effected. The load would frequently not reach the predetermined load within a predetermined period, which leads to the prolongation of the starting period.

The above-described starting time prolongation due to the increase of the thermal stress causes an unexpected confusion in a schedule or plan of the power plant system. Therefore, according to the prior art, in order to avoid the operation of the load fixing function due to the high thermal stress, the steam temperature at the outlet of the heater 14 is unduly controlled under a remarkably low temperature rising rate.

In contrast thereto, according to the effect of this embodiment, only by changing the portion corresponding to the circuit 52 in the conventional controlling system (FIG. 5), it is possible to control the steam temperature at the inlet of the turbine 15 to a predetermined level irrespective of the opening degree change of the valve 16.

Figure 3:
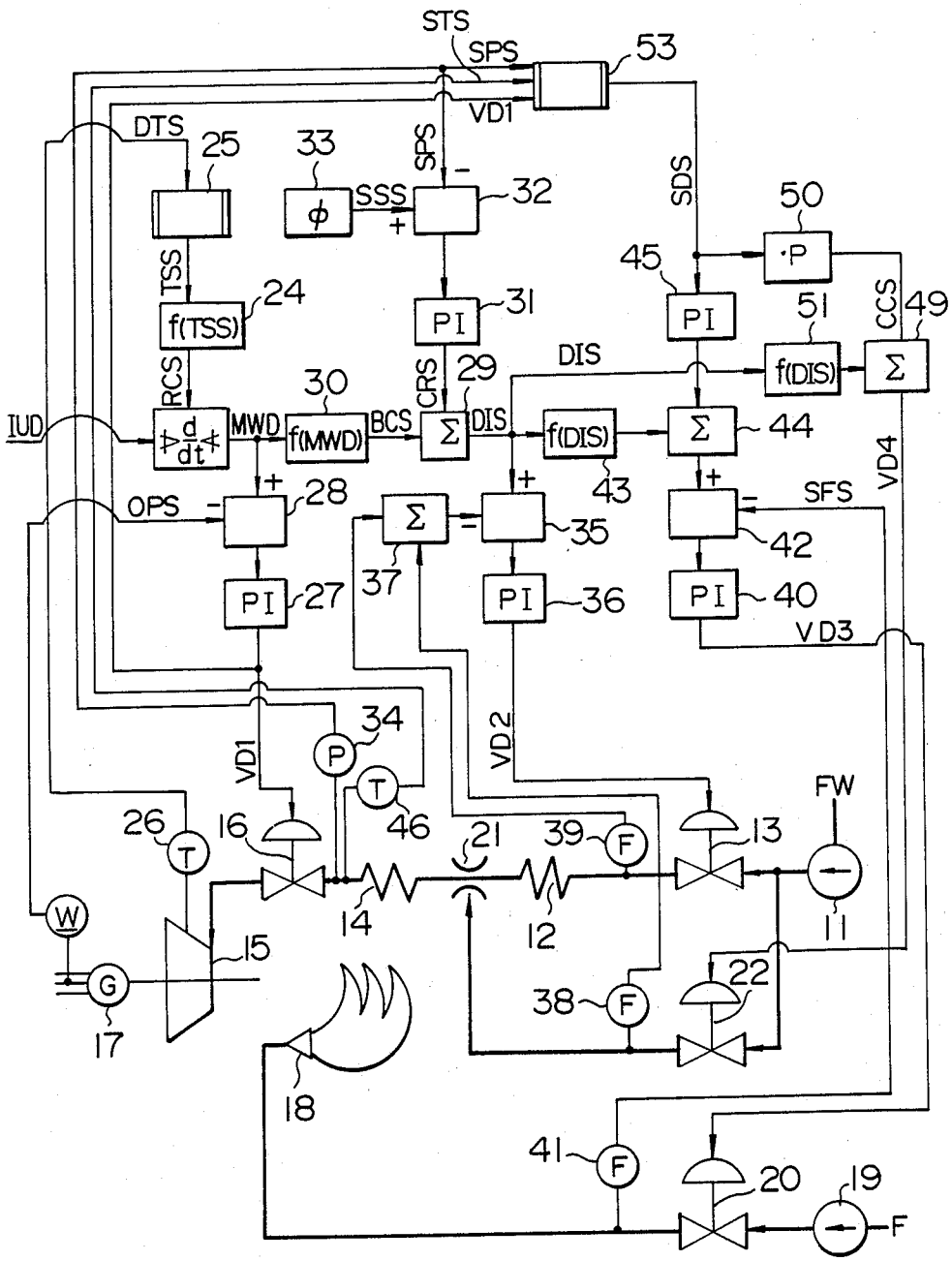
FIG. 3 is a block diagram of a second embodiment of the invention.
Figure 4:
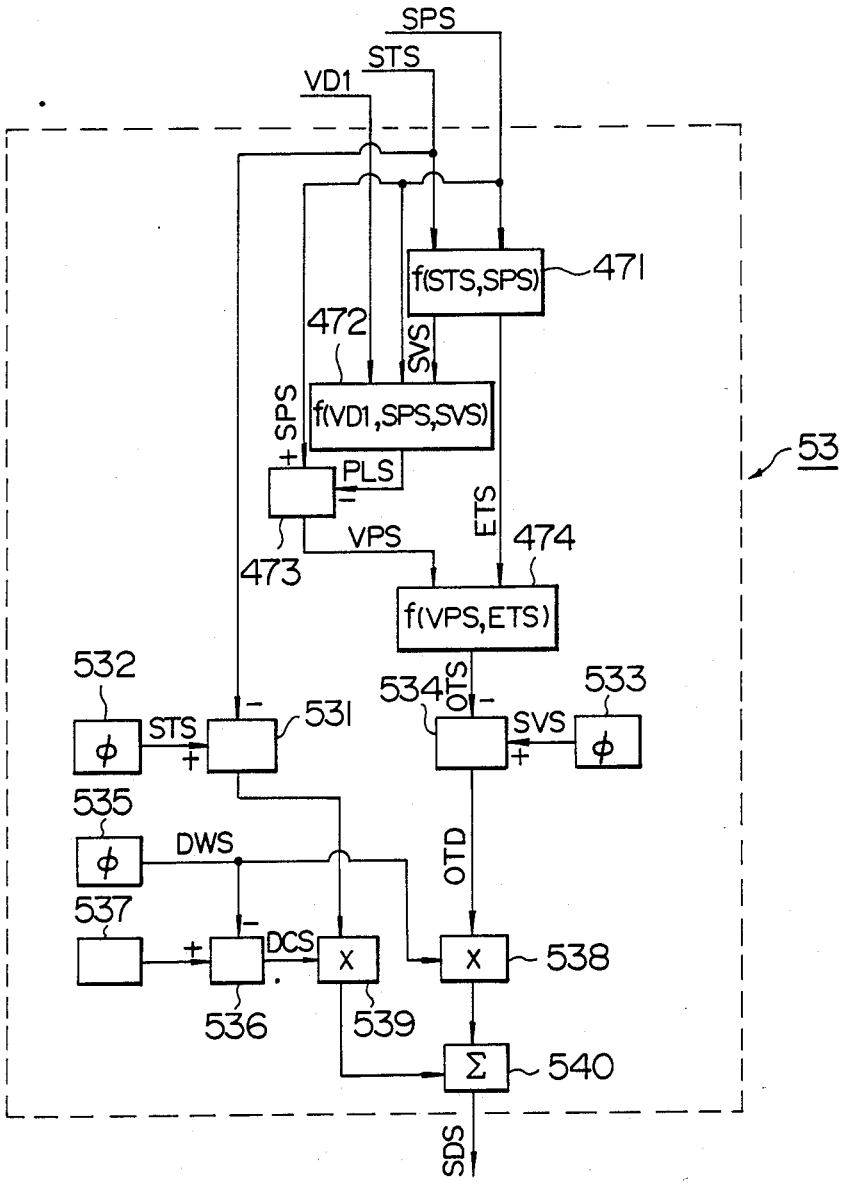
FIG. 4 is a view showing a detail of a steam temperature correction calculator shown in FIG. 3.

FIGS. 3 and 4 show another embodiment of the invention. In these figures, the same reference numerals are used to indicate the same or like components shown in FIGS. 1 and 2, thereby omitting the repeated explanation thereof.

In this embodiment shown in FIG. 3, the elements 48 and 52 for imparting the steam temperature deviation signal SDS shown in FIG. 5 are replaced by a steam temperature correction calculator 53 which receives the signals SPS, STS and VDl and for outputting a steam temperature deviation signal SDS.

FIG. 4 shows the details of the calculator 53. In this embodiment, a subtractor 531 subtracts the steam temperature signal STS at the outlet of the super heater 14 (or inlet of the valve 16) from a setting steam temperature signal STS given by a valve inlet steam temperature setting circuit 532 to obtain a valve inlet steam temperature deviation signal VIS. On the other hand, with respect to the steam temperature inferential value on the outlet side of the valve 16 given by the signal OTS, a set value signal SVS is given by a valve outlet temperature setter 533 and then a valve outlet temperature deviation signal OTD is obtained at a subtractor circuit 534. A deviation weight setting circuit 535 gives a deviation weight signal DWS within a range of 0 to 1. A subtractor 536 outputs a deviation correction signal DCS by subtracting the signal DWS from 1 from a function generator 537. The products between the signal DWS and the signal OTD and between the signal VIS and the signal DCS at multiplies 538 and 539 are added to each other at a summing circuit 540 to obtain the steam temperature deviation signal SDS. The signal SDS is replaced by the signal SDS in FIG. 5. Subsequently, the steam temperature control is performed in the same manner as the prior art to establish the system of the embodiment.

The effect of the embodiment is that if the value of the signal DWS is set at 1, the function of the embodiment shown in FIGS. 3 and 4 becomes identical to that of the embodiment shown in FIGS. 1 and 2. In the embodiment shown in FIGS. 3 and 4, the turbine inlet steam temperature control is performed irrespective of the opening degree change of the valve 16. Also, if the signal DWS is set at zero, by performing the outlet steam temperature control of the super heater 14 in the same manner as the prior art and changing continuously the signal DWS within the range of 0 to 1, it is possible to freely set the rate (weight) for the steam temperature deviation values at the inlet of the turbine 15 and the outlet of the super heater 14. In the embodiment shown in FIGS. 1 and 2, all the steam temperature change concomitant with the opening degree change of the valve 16 is imposed on the outlet temperature setting of the super heater 14 when the turbine inlet steam temperature control is performed. Accordingly, it is possible to set the value of the weight signal DWS for imparting the priority to the steam temperature change reduction (i.e. the steam temperature control) on the severe side with respect to the thermal stress generation with the turbine 15 and the super heater 14 corresponding to the condition, in order to cope with the fear that the thermal stress is serious at the outlet of the super heater 14 due to the change in the outlet steam temperature. The signal DWS may be set at a constant value prior to the starting operation or in the test operation of the plant. Otherwise, the set value may be changed in correspondence with the state in accordance with the thermal stress value RCS or the like.

In general, there is a trend that a service life consumption of a thick wall structure due to the thermal stress is abruptly increased when the thermal stress value exceeds an upper limit. Therefore, in the case where the temperature change is inevitable in any part in the plant as in the embodiment, the change is diffused to a plurality of parts to decrease the thermal stress values of the respective parts. This is very available to reduce the consumption of the service life of the entire plant.

According to the present invention, it is possible to predict the drop of the steam temperature when the steam has passed through the turbine inlet regulating valve. Therefore, it is possible to set the boiler outlet steam temperature so as to obtain the suitable turbine inlet temperature. The turbine load change may be performed smoothly.

Still another embodiment will now be described with reference to FIGS. 6 to 9.

In this embodiment, in view of the fact that the temperature and the pressure of steam at the outlet of the heater 14 are only aimed as so-called steam state quantities by the conventional controlling system to adjust them, to cause a trouble due to the high thermal stress of the turbine 15, the inlet steam temperature change rate of the turbine 15 which contributes inherently to the service life of the turbine 15 is managed. Furthermore, in order to maintain the service life consumption of the turbine 15 in a scheduled value each starting operation, it is necessary to limit the peak value of the generated thermal stress in the turbine 15. In view of this, the extent for controlling the inlet steam temperature change rate of the turbine 15 is determined for the control.

The essential part of this embodiment is constituted by means for relating to the boiler outlet temperature elevation control in order to control the inlet steam temperature change rate of the turbine 15 in view of the foregoing control and in consideration of the steam temperature change due to the valve opening degree change rate and the opening of the regulator valve 16.

In general, the pressure loss due to the provision of the valve is determined by a CV value determined by the valve opening degree, a flow rate and characteristic values (specific volume, viscosity coefficient and the like) of the fluid passing through the valve. In case of the regulating valve 16, with respect to the flow rate, it is possible to handle the valve 16 together with the turbine 15 downstream of the valve 16. However, in such a plant condition, a difference between the inlet pressure of the valve 16 and a discharge pressure of the turbine 15 is sufficiently large to exceed a so-called critical differential pressure condition. The flow rate passing through the valve 16 mainly depends on the opening degree of the valve and the inlet steam pressure and the characteristic value (in particular a specific volume) thereof rather than the discharging condition of the turbine 15.

It should be noted that the steam characteristic value is unitarily determined by the steam temperature and pressure (see the steam table issued by Japanese Society of Mechanical Engineering). The flow rate passing through the valve 16 is expressed by a function of the steam temperature and pressure and valve opening degree. Also, the pressure loss in the valve 16 and the outlet stream pressure of the valve 16 are expressed by a function of the above-described three factors.

A slight time lag is generated due to the thermal capacity of passageways toward the valve 16 and the turbine 15, but the turbine inlet steam temperature is a temperature corresponding to the outlet pressure of the valve 16 at the same enthalpy (including a heat quantity) as the inlet steam of the valve 16. In this case, it is possible to readily solve the mutual relationship among the steam temperature, pressure and enthalpy in accordance with the steam table or the like. As a result, the inlet stream temperature of the turbine 15 is also expressed by a function of the opening degree of the valve 16, the pressure and the temperature of steam at the inlet of the valve 16 in the same manner. In the case of the boiler apparatus in which the stream states are suitably controlled, there is a possibility that the inlet steam pressure of the valve 16 may be regarded as a constant value. If at least the opening degree of the valve 16 and the inlet stream temperature of the valve 16 are well picked up, it is possible to solve the inlet stream temperature of the turbine 15.

According to the foregoing method, it is unnecessary to directly measure the inlet steam temperature of the turbine 15. In addition, it is possible to avoid a problem concomitant with the inherent detection lag due to the thermal capacity of the detection end (including a thermowell or the like) in such a case that the inlet temperature of the turbine 15 is measured with, for example, a thermocouple. It is possible to detect immediately a value to which the temperature is converged in view of the affect of the time lag due to the thermal capacity of the passageways to the above-described valve 16 and turbine 15.

According to the present invention, the steam temperature control is performed so as to suppress the change in the inferential value of the inlet steam temperature of the turbine 15. It is apparent that a method (prediction control) for controlling the system by knowing, in advance, the convergent value of the temperature to be controlled without using the direct measured value that would be affected by the various lags in the control techniques is very effective.

According to the present invention, it is important to obtain the relationship between the stream temperature change rate and the thermal stress maximum value and the relationship between the thermal stress maximum value and the consumption value of the service life each thermal cycle. In the former case, the considerable time lag is inherent due to the thermal capacity, thermal conductivity or the like up to the thermal stress maximum value after the fluid temperature has been changed. In the latter case, it is impossible to obtain the relationship without consideration of the history of the one thermal cycle after the completion of the cycle. Accordingly, it is very difficult and troublesome to deal with the two relationships on the basis of the method (physical model) that will be described alter by using a system of differential equations on the basis of the physical law.

On the other hand, in the case where these relationships are applied to the plant, since the starting operation of the plant usually reaches a thousand order times during the durable service life, it is sufficient that the two relationships are exact on average. It would be negligible the errors if the errors due to the unexpected factors of the respective cases may be cancelled with each other. In such an application, it is suitable to obtain the relationships on the basis of the data of the actual cases (statistical method).

Amongst various statistic model procedures, a method known as linear regressive model method is recommended because it is simple and effective. This method will be briefly explained hereinunder. For further detail of the statistic model procedures, a reference may be made to "MULTIVARIATE ANALYSIS" by OKUNO et al, Nikka Giren Syuppan, 1971 and also to "STATISTIC ANALYSIS AND CONTROL OF DYNAMIC SYSTEM" by AKAIKE et al, SAIENSUSHA, 1972.

In case that combinations of variables ($x_i$, $y_i$) are obtained at moments i (i=1 . . . N), it is assumed that the relationship between the variables x and y is expressed by the following formula (1):

$$y = b_0 \exp(b_1 x) \quad \ldots (1)$$

the parameters $b_0$ and $b_1$ appearing in the formula can be determined in accordance with the following procedure.

The following formula (2) is obtained by linearizing logarithms of both sides of formula (1).

$$\log y = \log b_0 + b_1 x \quad \ldots (2)$$

The values $x_i$ at the successive moments are substituted for formula (2) and differences between the obtained values and the values of corresponding log $y_i$ are defined as $\epsilon_i$.

$$\epsilon_i = \log b_0 + b_1 x_i - \log y_i \quad \ldots (3)$$

where $\epsilon_i$ corresponds to an estimate error in the formula 1).

Then, the sum of the squares $\epsilon_i^2$ of the difference $\epsilon_i$ obtained for the successive moments is defined as S.

$$S = \sum_{i=1}^{N} \epsilon_i^2 = \sum_{i=1}^{N} (\log b_0 + b_1 x_i - \log y_i)^2 \quad (4)$$

For the purpose of the present invention, the parameters $b_0$ and $b_1$ should be determined in such manner as to minimize the value of the sum S in the formula (4). This can be conducted by determining the values $b_0$ and $b_i$ which satisfy the following two formulae (5) and (6) which are obtained by equalizing the partial differentiations of the formula (4) by log $b_0$ and $b_1$ to zero.

$$N \log b_0 + b_1 \sum_{i=1}^{N} x_i - \sum_{i=1}^{N} \log y_i = 0 \quad (5)$$

$$b_1 \sum_{i=1}^{N} x_i^2 + \log b_0 \sum_{i=1}^{N} x_i - \sum_{i=1}^{N} x_i \log y_i = 0 \quad (6)$$

The simultaneous equations (5) and (6) can be solved and then the following formulae (7) and (8) are obtained.

$$b_0 = \exp\left(\frac{\sum_{i=1}^{N} \log y_i \sum_{i=1}^{N} x_i^2 - \sum_{i=1}^{N} x_i \sum_{i=1}^{N} x_i \log y_i}{N \sum_{i=1}^{N} x_i^2 - \left(\sum_{i=1}^{N} x_i\right)^2}\right) \quad (7)$$

$$b_1 = \frac{N \sum_{i=1}^{N} x_i \log y_i - \sum_{i=1}^{N} x_i \sum_{i=1}^{N} \log y_i}{N \sum_{i=1}^{N} x_i^2 - \left(\sum_{i=1}^{N} x_i\right)^2} \quad (8)$$

When the values of parameters $b_0$ and $b_1$ are determined in accordance with the procedure explained above, if there is a close correlation between x and y due to their natures, the value of the sum S expressed by the formula (4) can be reduced to a sufficiently small value so that the assumption expressed by the formula (1) is validated. Since a close correlation exists between the temperature rising rate and the local maximum value of the thermal stress, as well as between the local maximum value of the thermal stress and the life consumption, the above-described procedure can be satisfactorily applicable for carrying out the present invention.

In order to theoretically support the validity of application of the above-described procedure in the boiler control system of the invention, a brief explanation will be made hereinunder as to the physical mechanism of the relationship between the temperature rising rate and the local maximum value of the thermal stress, as well as between the local maximum value of the thermal stress and the life consumption.

It is known that, with respect to the application of the invention, the two relationships between the temperature elevation rate and the thermal stress maximum value, and between the thermal stress maximum value and the service like consumption are remarkably related to each other. The foregoing calculation is effective.

The physical mechanism of the relationships between the temperature elevation rate and the thermal stress maximum value and between the thermal stress maximum value and the service life consumption will now be explained in brief in order to support the foregoing arguments.

The thermal stress occurring in the turbine causes a problem in parts where the thermal stress concentrates, e.g. projections or the like. It is well known that it is sufficient to assume the infinite planar plate that is in contact with the steam within the turbine and estimate the thermal stress value at that portion by multiplying the stress concentration coefficient with the generated thermal stress value on a surface that contact with the steam, for determining the thermal stress value in that portion. Also, a component uniform in the respective direction in parallel with the surface expressed by the following equation in the thermal stress on the surface is usually kept at maximum when it is vertical to the surface. Therefore, this fact should be noted for the purpose of controlling the thermal stress.

$$\delta = \frac{aE\alpha}{1-\nu}(T_{au} - T_i) \quad (9)$$

where $\delta$ is the thermal stress in the direction in parallel to the surface;

E is the Young's module;

$\alpha$ is the linear expansion coefficient;

$\nu$ is the Poisson ratio;

$T_{au}$ is the average metal temperature of the infinite planar plate;

$T_i$ is the metal temperature at the surface of the infinite planar plate; and a is the proportional constant.

The thermal transfer within the infinite planar plate is based upon the conductivity and basically meets Fourier equation. Since it is sufficient to consider the thermal transfers only in the vertical direction to the surface of the infinite planar plate, the phenomenon may be expressed by the following formula.

$$\frac{\partial T}{\partial t} = \frac{k}{wc} \cdot \frac{\partial^2 T}{\partial r^2} \quad (10)$$

where k is the heat conductivity;

c is the specific heat;

w is the radial distance; and

T is the metal temperature

By dividing the infinite planar plate in various layers in a thickness direction and by expressing each layer with a concentration constant, the j-the section counted from the surface is expressed by the following equation on the basis of the formula (10).

$$\frac{dT_j}{dt} = \frac{k}{wc} \cdot \frac{1}{(\Delta r)^2} \cdot \left[\frac{T_{i+1} - T_i}{\Delta r} - \frac{T_i - T_{i-1}}{\Delta r}\right] \quad (11)$$

where $\Delta r$ is the thickness of the divided layer.

Now, assume the typical case where the infinite planar plate is kept under a temperature equilibrium and heat is transferred from the fluid flowing along the infinite planar plate. In this case, since the heat change is transmitted from $t_{i+1}$ under the condition that $T_{i+1}$ is equal to $T_i$, the formula (11) is modified as follows.

$$\frac{wc(\Delta r)^2}{k} \cdot \frac{dT_i}{dt} = T_{i-1} - T_i \quad (12)$$

The formula (12) is a differential equation representative of a primary time lag characteristic. The lag time constant $\tau_o$ is expressed by the following formula.

$$\tau_o = \frac{wc(\Delta r)^2}{k} \quad (13)$$

Through a Laplace transform, the formula (12) is transformed into the following equation.

$$T^*_i = \frac{1}{1 + \tau_o S} T^*_{i-1} \quad (14)$$

where S is the Laplace operator (time differential operation); and a suffix * represents the value obtained through the Laplace transform.

By using the relationship of formula (14), the temperature $T_N$ of the N-th section within the metal thick wall is expressed as follows by the surface temperature $T_o$.

$$T_N^* = \left(\frac{1}{1+\tau_0 S}\right)\cdot\left(\frac{1}{1+\tau_0 S}\right)T^*_{N-2} = \left(\frac{1}{1+\tau_0 S}\right)^N T_0^* \quad (15)$$

As explained before, the thermal stress occurring in thick metal portion is evaluated by the difference between the temperature at the inner surface and the temperature of the internal section of the thick metal portion, as will be also understood from formula (9).

Representing such temperature difference by ΔT, the following relationship is derived from the formula (15).

$$\Delta T^* = T_0^* - T_N^* = \left\{1 - \left(\frac{1}{1+\tau_0 S}\right)\right\}T_0^* = \frac{1 - \{1 + {}_NC_1(\tau_0 S) + \ldots + {}_NC_i(\tau_0 S)^i + \ldots + (\tau_0 S)^N\}}{(1+\tau_0 S)^N}T_0^* \quad (16)$$

The development expressed by the formula (16) follows binominal thereon.

The higher-degree terms of S of the numerator in the formula (16) provide higher-degree of differentiation of the inner surface temperature $T_O$. Obviously, the variation in the temperature $T_O$ is smooth, so that the higher degree differentiation coefficients, therefore, can be regarded as being zero (0) and then the second or more higher degree terms can be neglected. In consequence, the formula (16) can be simplified as follows.

$$\Delta T^* \approx \frac{1}{1+\tau_0 S}\cdots\frac{1}{1+\tau_0 S}\cdot(N\tau_0)ST_0^* \quad (17)$$

where, $$\frac{1}{1+\tau_0 S}\cdots\frac{1}{1+\tau_0 S}$$

represents a N-th order log, $N_O$ represents a gain and $ST_O^*$ represents a rate of temperature change. The formula (17) means that the metal surface temperature difference of the pressure parts, which rules the value of the thermal stress, has high order lags of the rate of change in th metal surface temperature. This proves that the asymptote of the metal temperature difference is proportional to the rate of change in the fluid temperature. The condition where the metal temperature difference according to the formula (17) is closest to the asymptote at maximum is the state where the thermal stress is at local maximum. The formula (17) support the concept that the thermal stress local maximum value can be refined by the relationship with the steam temperature change rate.

In the same manner, the evaluation of the service life by using the thermal stress maximum value is described in detail in Japanese Patent Application 58-116201 entitled "Boiler Load Controlling Apparatus". Thus, the detailed explanation will be omitted here. In brief, the service life consumption depends upon the fatigue and creep. The fatigue depends upon the maximum width (peak-to-peak) between the positive and negative peaks corresponding to two components with respect to each of three axis directions of the primary stress difference in one thermal cycle. The creep depends upon the maximum value of the stress absolute value (corresponding stress) in the high temperature region. Therefore, there is a strong or remarkable correlation between the local maximum value of the thermal stress and the service life consumption. It is well known that it is available to support the relationship therebetween in the statistical expression.

Figure 6:
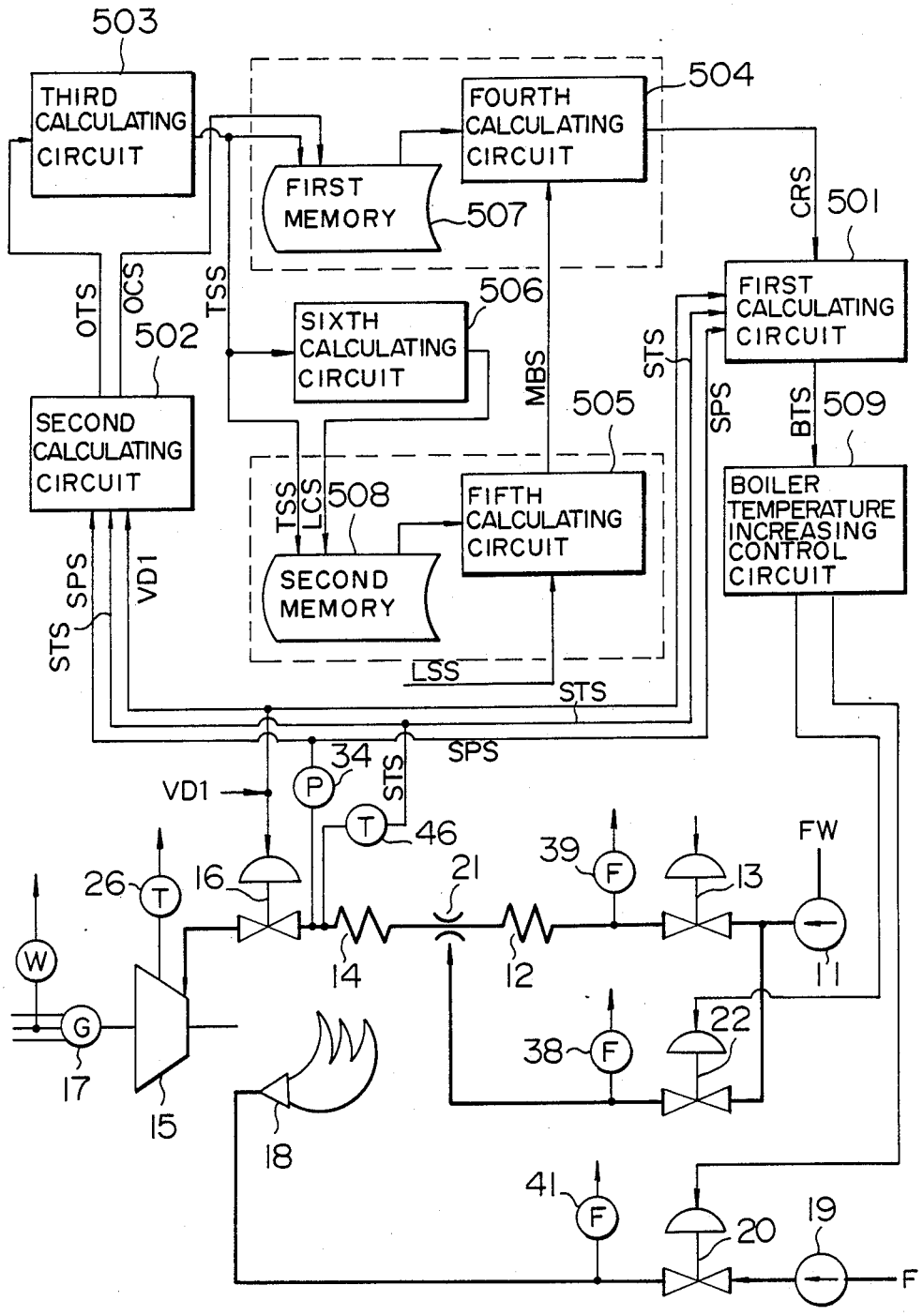
FIGS. 6 to 9 are views showing still another embodiment of the invention.

Now, referring to again FIG. 6, a first calculating circuit 501 receives a blade row inlet steam temperature change rate restricting signal CRS, a primary steam temperature signal STS, a primary steam pressure signal SPS and a regulator valve drive command signal VD1 at the present point, and outputs a boiler temperature increasing command signal BTS. In this embodiment, the blade row inlet steam temperature change rate restricting signal CRS is given by a fourth calculating circuit 502. It is however possible to dispensed with the fourth calculating circuit 504 or the like by setting the signal to a fixed value determined during the plant design stage or an experienced value.

A second calculating circuit 502 receives the primary steam temperature signal STS, the primary steam pressure signal SPS and the regulator valve drive command signal VD1 and calculates an outlet steam temperature signal OTS representing a steam temperature at an outlet of the regulator valve 16 and an outlet steam temperature change rate signal OCS representing a steam temperature change rate at the outlet of the regulator valve 16.

A third calculating circuit 503 receives the outlet steam temperature signal OTS and outputs a signal TSS representative of the thermal stress generated in movable blades of the turbine. Also, a sixth calculating circuit 506 receives the thermal stress signal TSS and outputs a movable blade service life consumption signal LCS each thermal cycle.

A fifth calculating circuit 505 receives a movable blade service life consumption share signal LSS relative to the load change or starting change per one cycle and outputs a movable blade thermal stress restricting signal MBS referring to the content in a second memory 508 storing data sets given by the service life consumption signal LCS and the thermal stress signal TSS. The service life consumption rate share signal LSS may be set so that the signal may be kept constant at the plant designing stage to save the setting operation or the signal may be set for the experienced service life consumption of the plant and the needs for the starting operation and rapid load change.

A fourth calculating circuit 504 receives the thermal stress restricting signal MBS and outputs a restrictor signal CRS for the steam temperature change rate at the inlet of the turbine blade row, referring to the content of a first memory 507 storing data couples given by the steam temperature change rate signal OCS and the thermal stress signal TSS. In the embodiment, the thermal stress restricting signal MBS is given by the fifth calculating circuit 505. However, it is possible to dispense with the fifth calculating circuit or the like by setting the signal at a constant determined during the plant design stage or by setting an experienced value.

A boiler temperature increasing controlling circuit 509 receives the command signal BTS to drive the operational end of the boiler.

Figure 7:
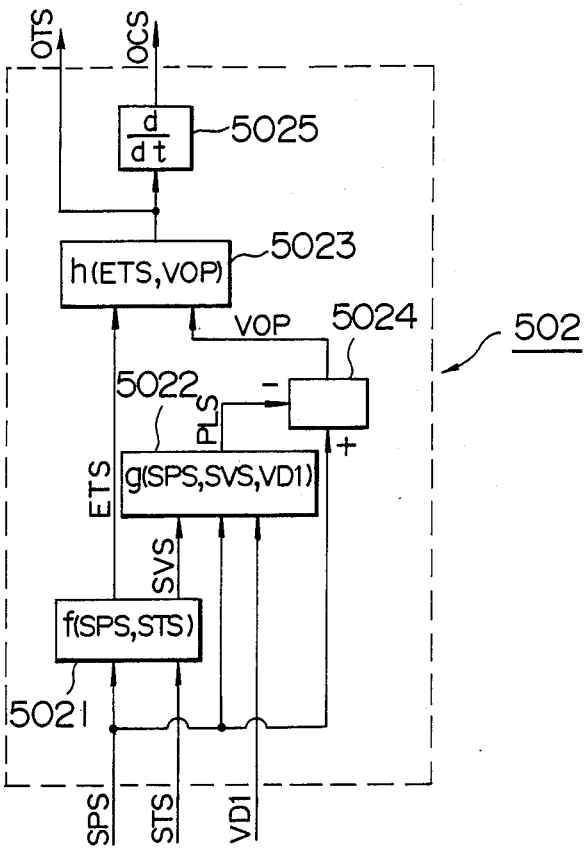

FIG. 7 shows the details of the second calculating circuit 502. In a steam table referencing circuit 5021, a specific volume signal SVS representative of a specific volume of steam at the inlet of the regulator valve 16 and an enthalpy signal ETS representative of an enthalpy of steam at the inlet of the regulator valve 16 are calculated. A valve characteristic function generator circuit 5022 calculates a pressure loss signal PLS representative of a pressure loss in the regulator valve 16 with taking the valve drive command signal VD1, the steam pressure signal SPS and the specific volume signal SVS. A steam table referencing circuit 5023 calculates a temperature of steam, an enthalpy of which is identical to that at the valve inlet corresponding to a valve outlet pressure. A valve outlet pressure signal VOP representative of such valve outlet pressure is obtained by subtracting the pressure loss signal PLS from the steam pressure signal SPS. As described above, the steam temperature obtained by the isoenthalpic change and its differential value are the outlet steam temperature signal OTS and the steam temperature change rate signal OCS, respectively.

Incidentally, reference numerals 5024 and 5025 denote a subtractor circuit and a differential circuit, respectively.

The third calculating circuit 503 is a thermal stress supervisory system that has been conventionally used. The schematic process has been expressed by the formulae (9) to (13).

The sixth calculating circuit 506 provides a service life evaluation method which is conventionally realized by using the thermal stress maximum value. Its detail is shown in Japanese Patent Application 58-116201.

The statistical methods shown in formulae (1) to (8) are applied to the data stored in the first memory 507 and the second memory 508 by the fourth and the fifth calculating circuit 504 and 505 respectively.

Since the first calculating circuit 501 is one of essential features of the present invention, its effect will be described in detail hereinunder. As described above, the steam temperature drop due to the regulator valve is an isoenthalpic change. The mechanism thereof has been explained in the description of the second calculating circuit 502 in conjunction with FIG. 7. These are expressed as follows.

$$\theta_o = h(Po, Hi) \quad \ldots (18)$$

$$P_o = Pi - g(Pi, A, \mu i) \quad \ldots (19)$$

$$\mu i = f_\mu(Pi, \theta i) \quad \ldots (20)$$

$$Hi = f_H(Pi, \theta i) \quad \ldots (21)$$

where $\theta i$ is the steam temperature at the inlet of the regulator valve 16;

$\theta_o$ is the steam temperature at the outlet of the regulator valve 16;

A is the opening degree of the regulator valve 16;

Hi is the enthalpy of steam at the inlet of the regulator valve 16;

Pi is the pressure of steam at the inlet of the regulator valve 16;

Po is the pressure of steam at the outlet of the regulator valve 16;

$f_\mu$ is the steam table in which the specific volume is obtained from the steam pressure and the steam temperature;

$f_H$ is the steam table in which the enthalpy is obtained from the steam pressure and the steam temperature;

g is the function giving the differential pressure from the steam pressure, the specific volume and the valve opening degree;

h is the steam table in which the temperature is given from the steam pressure and the enthalpy; and $\mu i$ is the specific volume of steam at the inlet of the regulator valve 16.

The formulae (19) to (21) are inserted into the formula (18) and the differential calculation is effected thereon to obtain the following formula related to the change rate of the steam temperature $\theta_o$ at the outlet of the regulator valve 16.

$$\frac{d\theta o}{dt} = \frac{\partial h}{\partial Pi}\left[\frac{dPi}{dt} - \frac{\partial g}{\partial Pi}\frac{dPi}{dt} - \frac{\partial g}{\partial A}\frac{dA}{dt} - \frac{\partial g}{\partial \mu i}\left\{\frac{\partial f\mu}{\partial Pi}\frac{dPi}{dt} + \frac{\partial f\mu}{\partial \theta i}\frac{d\theta i}{dt}\right\}\right] + \frac{\partial h}{\partial Hi}\left[\frac{\partial f\mu}{\partial Pi}\frac{dPi}{dt} + \frac{\partial f_H}{\partial \theta i}\frac{d\theta i}{dt}\right] \quad (22)$$

The object of the invention is attained by solving $\theta i$ that causes the change rate of $\theta_o$ to become a predetermined value under the given change rate of the given Pi and A, as follows.

$$\frac{d\theta i}{dt} = \frac{\dfrac{d\theta o}{dt} + \left[\dfrac{\partial h}{\partial Po}\cdot\dfrac{\partial g}{\partial A}\right]\dfrac{dA}{dt} - \left[\dfrac{\partial h}{Po}\left\{1 - \dfrac{\partial g}{\partial Pi} - \dfrac{\partial g}{\partial \mu i}\cdot\dfrac{\partial f\mu}{\partial Pi}\right\} + \dfrac{\partial h}{\partial Hi}\cdot\dfrac{\partial f_H}{\partial Pi}\right]\dfrac{dPi}{dt}}{-\dfrac{\partial h}{\partial Po}\cdot\dfrac{\partial g}{\partial \mu i}\cdot\dfrac{\partial f\mu}{\partial \theta i} + \dfrac{\partial h}{\partial Hi}\cdot\dfrac{\partial f_H}{\partial \theta i}} \quad (23)$$

Figure 8:
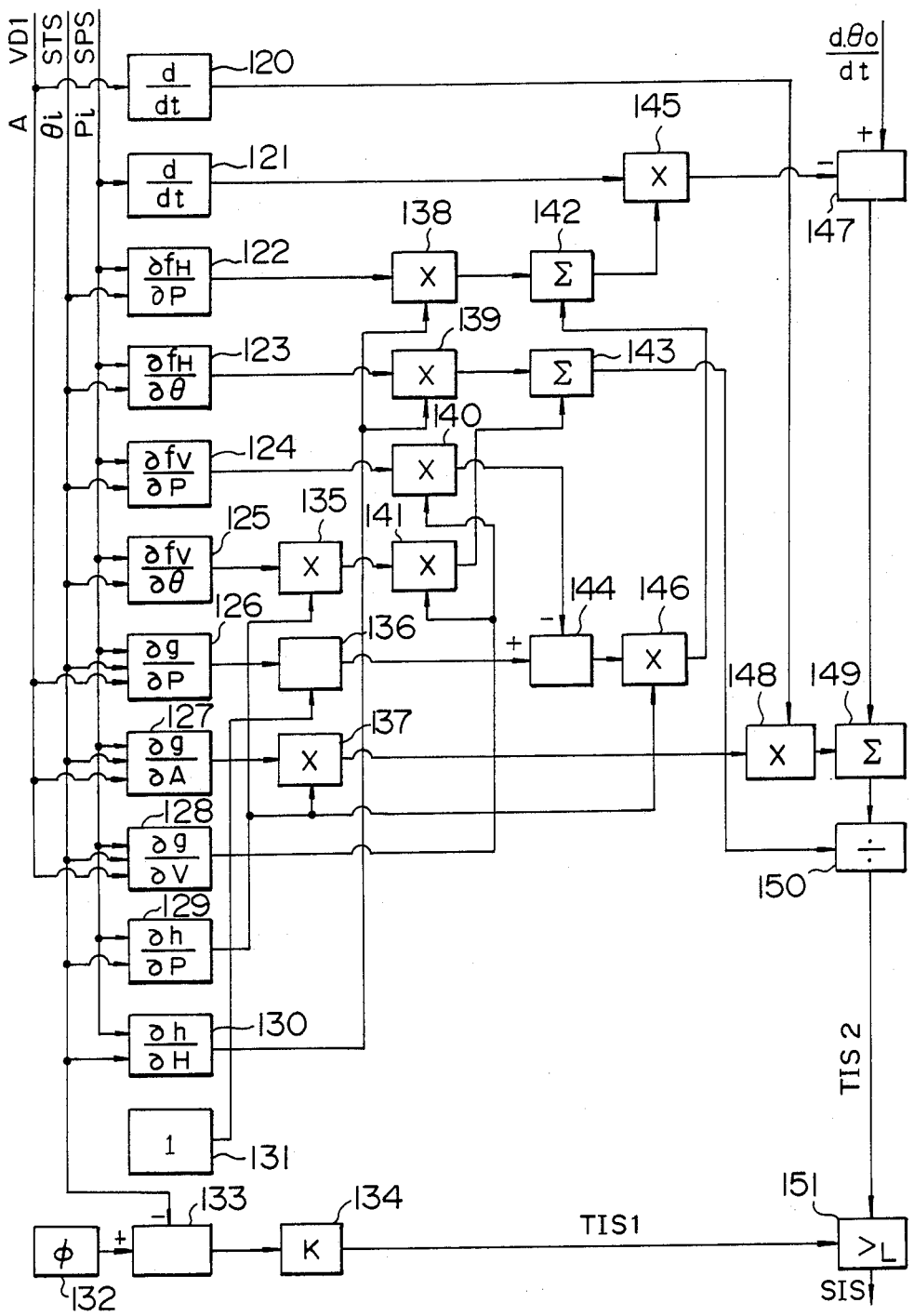

The partial differential coefficients in the above formula may be obtained if the present values Pi, A and $\theta i$ are given. Specifically, the first calculating circuit 501 is shown in FIG. 8. A temperature increasing signal TIS2 in FIG. 8 corresponds to the change rate of $\theta i$ given by the formula (23).

The system shown in FIG. 8 comprises differential circuits 120 and 121, partial differential coefficient generating circuits 122 to 130, subtractor circuits 133, 136, 144 and 147, a constant multification circuit 134, a multifying circuits 135, 137 to 141, 145, 146 and 148, summing circuits 142, 143 and 149, a division circuit 150, and a selection circuit 151.

In FIG. 8, the temperature increasing rate command signal TIS1 is obtained from the difference between the primary steam temperature signal STS at the present time and the primary steam temperature given by a signal setting circuit 132. A selected temperature increasing rate command signal SIS is obtained by selecting a lower one between the signals TIS1 and TIS2 at the selection circuit 151 to thereby provide a specific effect of the embodiment. Namely, if the primary steam temperature (signal STS) is equal to or larger than the set value, the signal TIS1 is zero or negative. The signal TIS1 is selected to stop the temperature increase over the set value. Also, if the primary steam temperature exceeds the set value, the negative selected temperature increasing rate command signal SIS is applied so as to return the temperature back to the set value.

The operation of the boiler temperature increasing rate controlling means is shown in Japanese Pat. Application No. 59-145932 entitled "Boiler starting Controlling Apparatus". The plant control input (optimum control input) such as a valve opening degree or the like is calculated under the condition of minimum fuel supply amount in the starting operation at a temperature increasing rate given by the signal SIS according to the plant state, thereby performing the starting operation.

If the technique disclosed in Japanese Pat. Application No. 61-076801 entitled "Boiler Starting Operation Controlling Apparatus" is applied as the temperature increasing rate controlling means, it is possible to apply the Kalman filter theory or the optimum regulator theory thereto. It is advantageous that the optimum control input may minimize the index of performance.

In order to effect a minimum modification to the conventional system shown in FIG. 5 for the boiler temperature increasing rate controlling means, the temperature increasing rate command value (SIS) is integrated into a temperature command value which is applied to the subtractor circuit 48 instead of the primary steam temperature setting signal PSS given by the setter 52 shown in FIG. 5.

Figure 9:
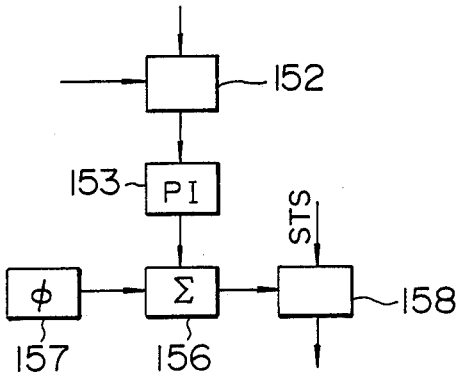

According to another embodiment of the invention, a cascade control is applied to the primary steam temperature setting signal in the control system shown in FIG. 5 with a deviation between the actual temperature increasing rate (OCS) at the inlet of the blade row and the temperature increasing rate restricting value (ORS) thereof. This is shown in FIG. 9. This method is advantageous that the invention may be realized in the simplest way.

In FIG. 9, reference numerals 152 and 158 denote subtractor circuits. Reference numerals 153 and 156 denote a proportional-integral circuit and summing circuit, respectively.

The present invention may enjoy the following advantages.

(i) It is possible to control the inlet steam temperature change of the turbine blade row below a predetermined level in view of the steam temperature change concomitant with the flow-through of the regulator valve.

(ii) It is possible to control quickly responsibility while predicting the convergent value of the temperature change rate upon the control of the inlet steam temperature change rate of the turbine blade row.

(iii) It is possible to control the turbine blade row inlet steam temperature change rate while keeping the maximum value of the thermal stress generated in the turbine blade row below a predetermined level.

(iv) It is possible to perform the turbine blade row inlet steam temperature control along the set service life consumption of the turbine blade row.

What is claimed is:

1. A boiler/turbine plant controlling apparatus comprising:

means for driving a turbine inlet steam flow regulator valve on the basis of a difference between a load command signal and an actually measured output signal of a plant;

means for driving a boiler feed water flow regulator valve on the basis of a difference between a value which is obtained by adding a boiler feed water amount with a super heater feed water amount and a value represented by a boiler input command signal;

means for driving a fuel flow regulator valve in accordance with an actually measured fuel amount and a fuel command signal corrected by a difference between a primary steam temperature setting signal and a steam temperature signal representative of a primary steam temperature measured value; and means for driving a super heater water feed valve on the basis of a difference between the primary steam temperature setting value and the steam temperature signal representative of the primary steam temperature measured value;

wherein the improvement comprises:

means for calculating a steam temperature drop between an inlet of said steam flow regulator valve disposed at an inlet of the steam turbine and an inlet of a blade row of said steam turbine on the basis of an opening degree of said steam regulator valve and a temperature and a pressure of steam at the inlet of said steam flow regulator valve; and means for correcting said primary steam temperature setting value on the basis of the calculated value of said calculating means.

2. A boiler/turbine plant controlling apparatus in which a steam turbine is connected through a steam flow regulator valve to a steam outlet port means of a boiler having a steam temperature change rate controller, said apparatus characterized by comprising a first calculating means for receiving at least a steam temperature signal representative of steam temperature at an inlet of said steam flow regulating valve, a steam pressure signal representative of steam pressure thereat, an opening degree signal representative of an opening degree of said regulator valve and information regarding steam temperature at an inlet of a blade row of said steam turbine and for calculating at least a steam temperature change rate desired value or a steam temperature change rate correction desired value of said boiler.

3. The controlling apparatus according to claim 2, further comprising a second calculating means for receiving said steam temperature signal, said steam pressure signal and said opening degree signal and for calculating a steam temperature and a steam temperature change rate at the inlet of the blade row of said steam turbine.

4. The controlling apparatus according to claim 3, further comprising:

a third calculating means for calculating a thermal stress of turbine blades of said turbine by using said steam temperature or steam temperature change rate given by said second calculating means;

a first memory means for storing sets of values of the thermal stress calculated by said third calculating means and said steam temperature or steam temperature change rate calculated in said second calculating means; and a fourth calculating means for receiving a thermal stress peak restricting value of the turbine blades, which value is set in advance or for each command, and for calculating a steam temperature change rate restricting value for the inlet of the blade row of said turbine to be fed to said first calculating means by using said sets of the values stored in said first memory means.

5. The controlling apparatus according to claim 4, further comprising:

a fifth calculating means for receiving the thermal stress value of the blade of said turbine given by said third calculating means and for calculating a service life consumption of the turbine blade;

a second memory means for storing sets of values of the service life consumption determined by said fifth calculating means and the thermal peak value determined by said third calculating means; and a sixth calculating means for receiving an allowable service life consumption setting value for a starting operation, a stop operation or a load change of said turbine blades and for calculating the thermal stress peak restricting value of said turbine blades to be given to said fourth calculating means.

* * * * *